US009095199B2

(12) United States Patent
Chen

(10) Patent No.: US 9,095,199 B2
(45) Date of Patent: Aug. 4, 2015

(54) MULTI-COLOR COSMETIC PACKAGING TIN

(76) Inventor: Jianhai Chen, Shanghai (CN)

( * ) Notice: Subject to any disclaimer, the term of this patent is extended or adjusted under 35 U.S.C. 154(b) by 0 days.

(21) Appl. No.: 13/699,829

(22) PCT Filed: Apr. 2, 2011

(86) PCT No.: PCT/CN2011/072404

§ 371 (c)(1),
(2), (4) Date: Nov. 26, 2012

(87) PCT Pub. No.: WO2012/068816

PCT Pub. Date: May 31, 2012

(65) Prior Publication Data

US 2013/0233338 A1 Sep. 12, 2013

(30) Foreign Application Priority Data

Nov. 23, 2010 (CN) ..... 2010 1 0555477

(51) Int. Cl.
*A45D 40/24* (2006.01)
*A45D 40/26* (2006.01)

(52) U.S. Cl.
CPC ..... *A45D 40/26* (2013.01); *A45D 40/24* (2013.01)

(58) Field of Classification Search
USPC ..... 132/313, 314, 318, 320; 401/34–35
See application file for complete search history.

(56) References Cited

U.S. PATENT DOCUMENTS 1,547,814 A * 7/1925 Hyde ..... 401/81
1,565,142 A * 12/1925 Coryell ..... 401/78
1,695,407 A * 12/1928 Anderson ..... 401/74
1,781,852 A * 11/1930 Lyhne ..... 401/78
1,899,748 A * 2/1933 Cornell, Jr. ..... 401/78
1,953,910 A * 4/1934 Parkin ..... 401/59
1,974,418 A * 9/1934 Cornell, Jr. ..... 401/78
2,055,414 A * 9/1936 Lehmann ..... 401/59
2,057,502 A * 10/1936 Peterson ..... 401/59
2,081,286 A * 5/1937 Woessner ..... 401/77
2,222,415 A * 11/1940 Landwehr ..... 401/78
2,426,883 A * 9/1947 Kartyshai ..... 132/314
2,482,368 A * 9/1949 Reichenbach ..... 401/61
2,523,683 A * 9/1950 De Mario ..... 401/31
2,579,887 A * 12/1951 Vierling ..... 401/30
2,628,624 A * 2/1953 De Mario ..... 401/31
3,001,531 A * 9/1961 Gazdik ..... 401/49
3,230,960 A * 1/1966 Moore et al. ..... 401/78
3,335,853 A * 8/1967 Geisel ..... 401/68
3,346,103 A * 10/1967 Swenson ..... 401/74
3,547,551 A * 12/1970 Gruska ..... 401/78
3,561,592 A * 2/1971 McCool ..... 206/534
3,887,287 A * 6/1975 Rosh, Jr. ..... 401/35
3,910,705 A * 10/1975 Schumacher ..... 401/30

(Continued)

*Primary Examiner* — Rachel Steitz
*Assistant Examiner* — Jennifer Gill
(74) *Attorney, Agent, or Firm* — Jackson IPG PLLC; Demian K. Jackson

(57) ABSTRACT

A multi-color cosmetic packaging tin with a base, a bottom cover, a middle sleeve, a screw sleeve, a core post and an upper cover. The core post is a cylinder formed of a plurality of hollow bodies. The base is sleeved in the bottom cover and the screw sleeve is sleeved in the middle sleeve. A breach on the screw sleeve is matched with a button on the middle sleeve and the middle sleeve includes a screw sleeve sleeved on the base. The core post is sleeved in the base and a plurality of slide blocks are formed in respective longitudinal slots in the base. The upper cover is disposed on the middle sleeve and grooves in the upper cover are clamped with upper clamping rings of the middle sleeve.

1 Claim, 8 Drawing Sheets

(56) References Cited

U.S. PATENT DOCUMENTS

| | | | | | |
|---|---|---|---|---|---|
| 4,108,558 | A | * | 8/1978 | Radice et al. | 401/78 |
| 4,692,046 | A | * | 9/1987 | Lan | 401/32 |
| D325,281 | S | * | 4/1992 | Jordan | D3/302 |
| 5,102,249 | A | * | 4/1992 | Holloway et al. | 401/78 |
| 5,186,560 | A | * | 2/1993 | Holloway | 401/78 |
| 5,368,405 | A | * | 11/1994 | Sixiong | 401/35 |
| 5,504,962 | A | * | 4/1996 | Byun | 15/184 |
| 5,746,530 | A | * | 5/1998 | Oota | 401/88 |
| 5,749,664 | A | * | 5/1998 | Inoue et al. | 401/78 |
| 5,842,805 | A | * | 12/1998 | Pierpont | 401/78 |
| 5,851,078 | A | * | 12/1998 | Bow et al. | 401/78 |
| 5,984,552 | A | * | 11/1999 | Ackermann et al. | 401/74 |
| 6,035,866 | A | * | 3/2000 | Seneco et al. | 132/318 |
| 6,102,599 | A | * | 8/2000 | Pierpont | 401/78 |
| 6,290,414 | B1 | * | 9/2001 | Seebach et al. | 401/78 |
| 6,557,563 | B2 | * | 5/2003 | Ohba | 132/318 |
| 6,561,711 | B1 | * | 5/2003 | Pierpont | 401/78 |
| 6,739,779 | B1 | * | 5/2004 | Deeds | 401/47 |
| 6,755,585 | B2 | * | 6/2004 | Gueret | 401/125 |
| 6,895,628 | B1 | * | 5/2005 | Anderson | 15/106 |
| 7,553,101 | B2 | * | 6/2009 | Harano et al. | 401/98 |
| 7,674,061 | B2 | * | 3/2010 | Baines et al. | 401/213 |
| 7,806,614 | B2 | * | 10/2010 | Desson et al. | 401/65 |
| 7,938,268 | B1 | * | 5/2011 | Kuo | 206/581 |
| 8,403,577 | B2 | * | 3/2013 | Khoshnevis | 401/35 |
| 2009/0074500 | A1 | * | 3/2009 | Pires et al. | 401/31 |
| 2009/0257811 | A1 | * | 10/2009 | Brachman | 401/34 |
| 2012/0014736 | A1 | * | 1/2012 | Pires et al. | 401/35 |
| 2012/0275840 | A1 | * | 11/2012 | Liu | 401/35 |
| 2013/0233338 | A1 | * | 9/2013 | Chen | 132/314 |

* cited by examiner

MULTI-COLOR COSMETIC PACKAGING TIN

FIELD OF THE INVENTION

The invention relates to a packaging box in the technical field of cosmetics, in particular to a multi-color cosmetic packaging tin.

BACKGROUND OF THE INVENTION

The traditional packaging tins (boxes) for cosmetics such as eye shadows, lipsticks and blushers have single function and must be carried and used one by one when different cosmetics are required, which brings inconvenience to customers in the carry and use of the packaging tins (boxes) and increases the cost.

SUMMARY OF THE INVENTION

The objective of the invention is to overcome the defects in the prior art and provide a multi-color cosmetic packaging tin which can store various different cosmetics in one packaging tin at the same time, so that the tin is convenient for customers to choose and use, simple in structure and convenient to carry and use.

In order to achieve the objective, the invention adopts the specific technical proposal that:

The invention relates to a multi-color cosmetic packaging tin, which comprises a base, a bottom cover, a middle sleeve, a screw sleeve, a core post and an upper cover, wherein the base is cylindrical in shape; a plurality of longitudinal slots are uniformly formed on the upper end of the cylindrical wall of the base along the axial direction; a spline is disposed on the outerwall of the lower end of the cylindrical wall of the base; the bottom cover is a blind end cylinder; grooves are radially formed in the cylindrical opening of the bottom cover; a spline is disposed on the inner wall of the bottom cover; the middle sleeve is cylindrical in shape; a button is disposed in the middle of the cylindrical body of the middle sleeve; upper clamping rings and lower clamping rings are respectively disposed on outerwalls of upper and lower ends of the cylindrical body of the middle sleeve; the screw sleeve is cylindrical in shape; a rebate is radially formed on the inner wall of one end of the screw sleeve; a breach is formed on the rebate; a spiral groove is formed on the inner wall of the screw sleeve; a beginning end of the spiral groove is disposed at the breach; the core post is a cylinder formed by a plurality of hollow bodies; chutes are formed on outer cambered surfaces of a plurality of the hollow bodies respectively; slide blocks are embedded into the chutes; springs are disposed between the slide blocks and outerwalls of the hollow bodies; the upper cover is a covered cylinder; grooves are radially formed in the cylindrical opening of the upper cover; a rib is formed on the inner wall of the upper cover; the base is sleeved in the bottom cover; the screw sleeve is sleeved in the middle sleeve and the breach on the screw sleeve is matched with the button on the middle sleeve; the middle sleeve provided with the screw sleeve is sleeved on the base and the lower clamping rings of the middle sleeve are clamped with the grooves in the bottom cover; the core post is sleeved in the base and a plurality of the slide blocks are formed in respective chutes in the base correspondingly; the upper cover is disposed on the middle sleeve provided with the screw sleeve; and the grooves in the upper cover are clamped with the upper clamping rings of the middle sleeve.

The multi-color cosmetic packaging tin can store various different cosmetics in one packaging tin at the same time, so that the tin is convenient for customers to choose and use, simple in structure and convenient to carry and use.

DETAILED DESCRIPTION OF THE PREFERRED EMBODIMENTS

Figure 1:
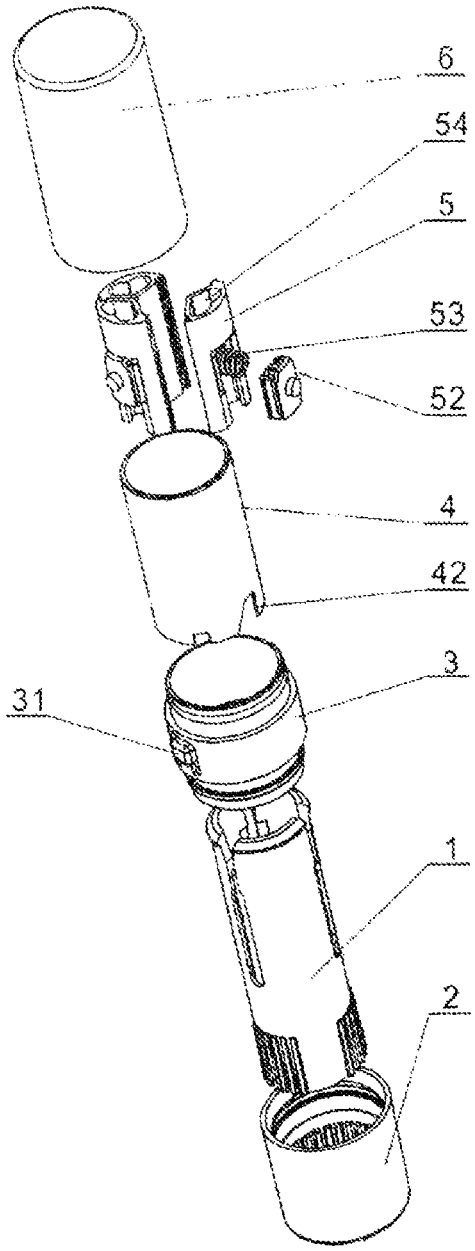
FIG. 1 is a structure diagram of the multi-color cosmetic packaging tin provided by the invention.
Figure 2:
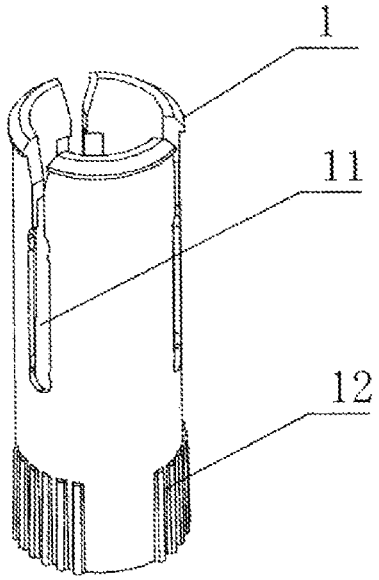
FIG. 2 is a structure diagram of a base for the multi-color cosmetic packaging tin provided by the invention.

As illustrated in FIG. 2, a base 1 of a multi-color cosmetic packaging tin provided by the invention is cylindrical in shape; a plurality of longitudinal slots 11 are uniformly formed on the upper end of the cylindrical wall of the base 1 along the axial direction; and a spline 12 is disposed on the outside of the lower end of the cylindrical wall of the base 1.

Figure 3:
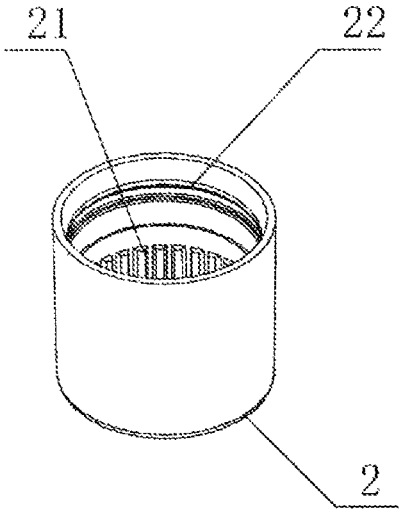
FIG. 3 is a structure diagram of a bottom cover for the multi-color cosmetic packaging tin provided by the invention.

As illustrated in FIG. 3, a bottom cover 2 of the multi-color cosmetic packaging tin provided by the invention is a blind end cylinder; grooves 22 are radially formed in the cylindrical opening of the bottom cover 2; and a spline 21 is disposed on the inner wall of the bottom cover 2.

Figure 4:
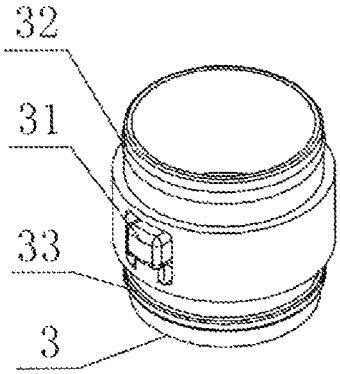
FIG. 4 is a structure diagram of a middle sleeve for the multi-color cosmetic packaging tin provided by the invention.

As illustrated in FIG. 4, a middle sleeve 3 of the multi-color cosmetic packaging tin provided by the invention is cylindrical in shape; a button 31 is disposed in the middle of the cylindrical body of the middle sleeve 3; and upper clamping rings 32 and lower clamping rings 33 are respectively disposed on upper and lower ends of the outside of the cylindrical body of the middle sleeve 3.

Figure 5:
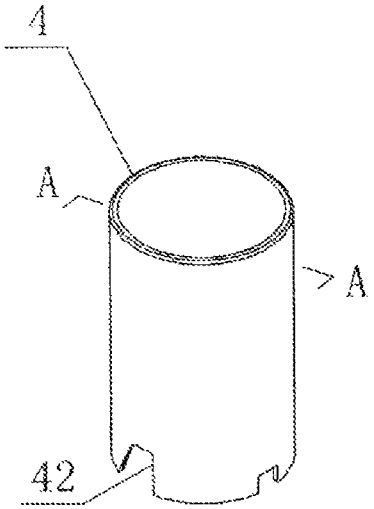
FIG. 5 is a structure diagram of a screw sleeve for the multi-color cosmetic packaging tin provided by the invention.
Figure 6:
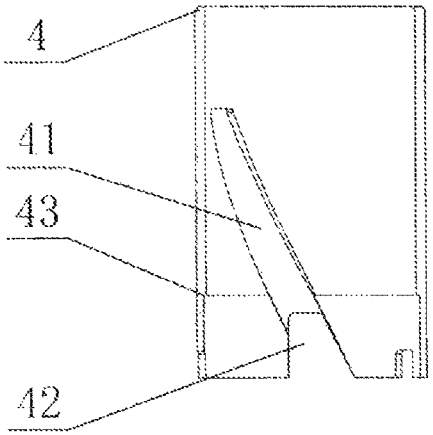
FIG. 6 is an A-A view of FIG. 5.

As illustrated in FIGS. 5 and 6, a screw sleeve 4 of the multi-color cosmetic packaging tin provided by the invention is cylindrical in shape; a rebate 43 is radially formed on the inner wall of the one end of the screw sleeve 4; a breach 42 is formed on the rebate 43; a spiral groove 41 is formed on the inner wall of the screw sleeve 4; and a beginning end of the spiral groove 41 is disposed at the breach 42.

Figure 7:
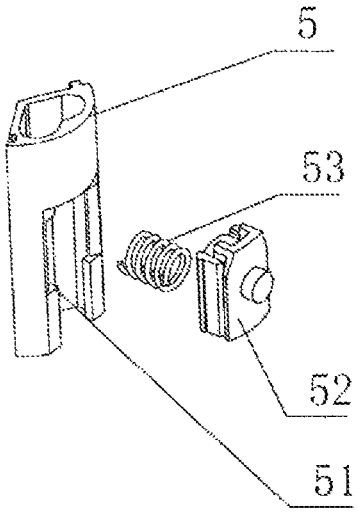
FIG. 7 is a structure diagram of a core post for the multi-color cosmetic packaging tin provided by the invention.

As illustrated in FIG. 7, a core post 5 of the multi-color cosmetic packaging tin provided by the invention is a cylinder formed by a plurality of hollow bodies 54 (FIG. 11); chutes 51 are formed on outer cambered surfaces of each of the plurality of the hollow bodies 54 respectively; slide blocks 52 are embedded into the chutes 51; and springs 53 are disposed between the slide blocks 52 and outerwalls of the hollow bodies 54.

Figure 8:
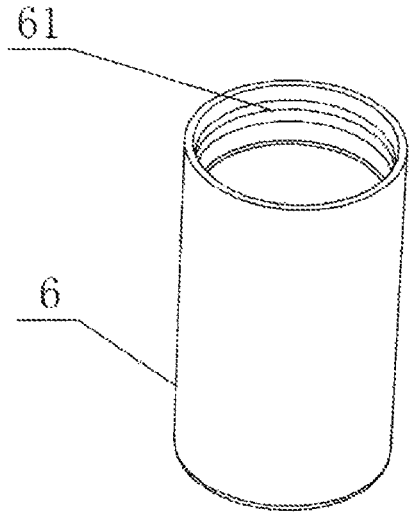
FIG. 8 is a structure diagram of an upper cover for the multi-color cosmetic packaging tin provided by the invention.
Figure 9:
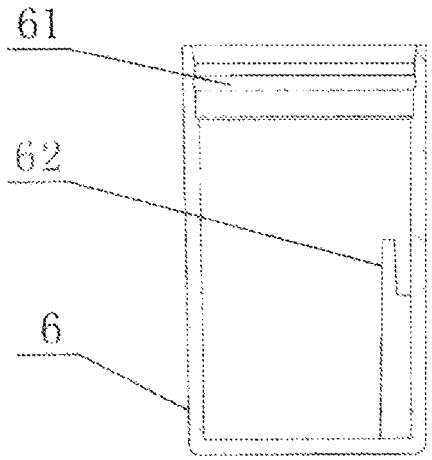
FIG. 9 is a B-B view of FIG. 8.

As illustrated in FIGS. 8 and 9, an upper cover 6 of the multi-color cosmetic packaging tin provided by the invention is a covered cylinder; grooves 61 are radially formed in the cylindrical opening of the upper cover 6; and a rib 62 is formed on the inner wall of the upper cover 6.

Figure 10:
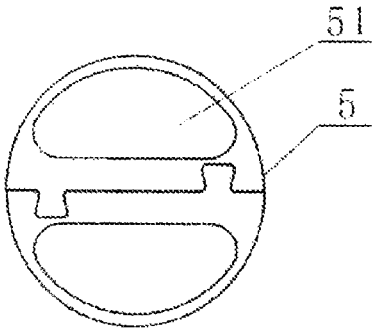
FIGS. 10, 11 and 12 are sectional views of the core post for the multi-color cosmetic packaging tin provided by the invention, in which the number of hollow bodies is different.
Figure 11:
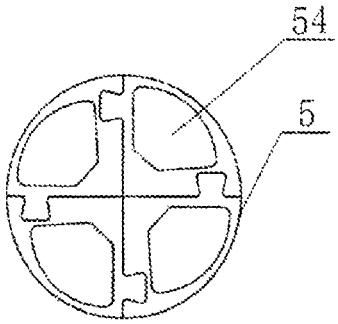
Figure 12:
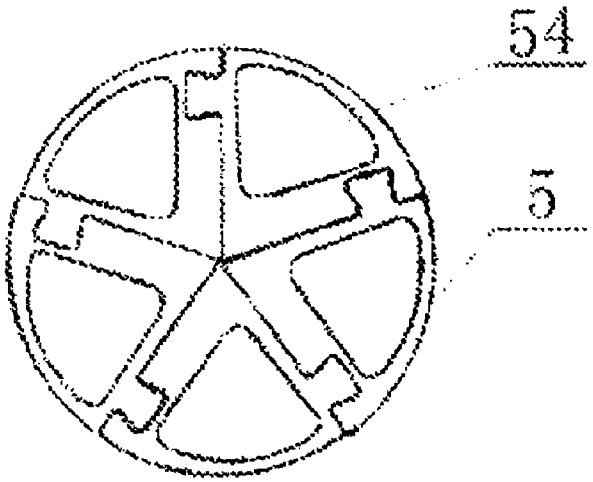

As illustrated in FIGS. 10, 11 and 12, a number of the hollow bodies 54 in the core post 5 of the multi-color cosmetic packaging tin provided by the invention is set as required, and cosmetics such as lipsticks, eye shadows and blushers are placed in the hollow bodies 54.

Figure 13:
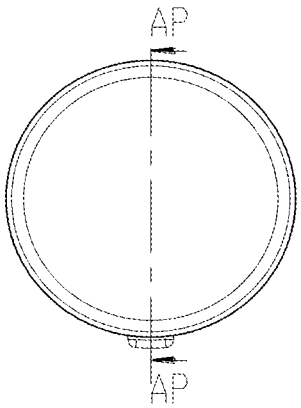
FIG. 13 is an end sectional assembled view of a multi-color cosmetic packaging tin.
Figure 14:
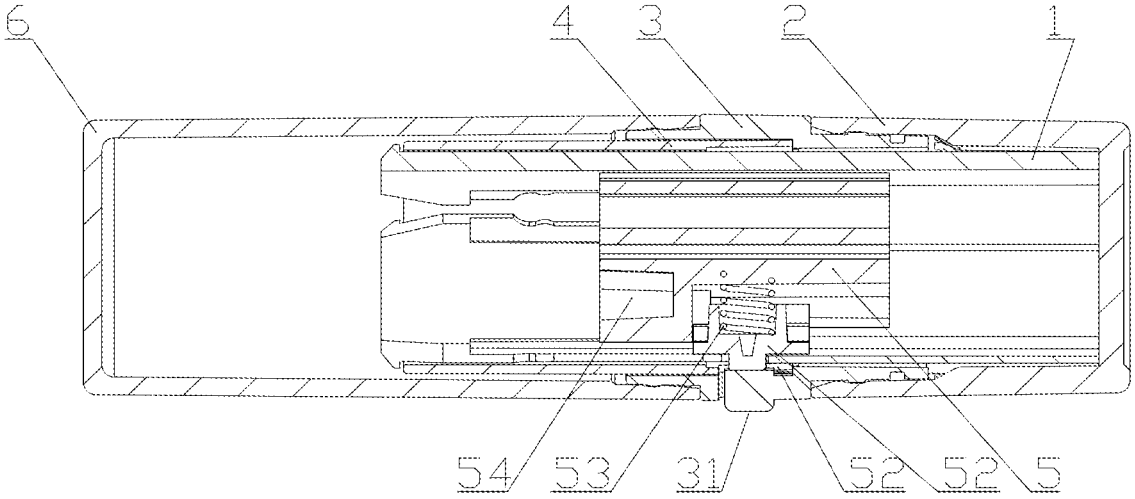
FIG. 14 is a side sectional assembled view of a multi-color cosmetic packaging tin.

FIG. 13 shows an end sectional assembled view at A-A of FIG. 5. FIG. 14 shows a side sectional view of an assembled multi-color cosmetic packaging tin including the base 1, bottom cover 2, middle sleeve 3, screw sleeve 4, core posts 5, upper cover 6, slide blocks 52, and hollow bodies 54.

The use method of the multi-color cosmetic packaging tin provided by the invention is as follows:

a) Removing the upper cover: holding the middle sleeve 3, axially pulling the upper cover 6 for the grooves 61 in the upper cover 6 to be disengaged from the upper clamping rings 32 of the middle sleeve 3, and pulling out the upper cover 6.

b) Choosing a cosmetic required: holding the bottom cover 2 and rotating the middle sleeve 3. As the spline 12 of the base 1 is sleeved in the spline 21 of the bottom cover 2, the base 1 and the bottom cover 2 cannot rotate relative to each other; as the screw sleeve 4 is fixedly sleeved in the cylinder of the middle sleeve 3, the screw sleeve 4 and the middle sleeve 3 cannot rotate relative to each other as well; and thus the screw sleeve 4 rotates synchronously relative to the base 1 when the middle sleeve 3 rotates relative to the bottom cover 2. During the rotation, the slide blocks 52 are disposed in the rebate 43 of the screw sleeve 4. When the breach 42 on the screw sleeve 4 is aligned with a slide block 52, the slide block 52 is sprang out in the longitudinal slots 11 and clamped into the breach 42 of the screw sleeve 4. Herein, a hollow body 54 in the core post 5, corresponding to the slide block 52, is chosen, namely the cosmetic required is chosen. If other cosmetics are required, a user only needs to press the button 31 on the middle sleeve 3. Herein, the slide blocks 52 are driven by the button 31 to overcome the elastic force of the springs 53 and be withdrawn in the longitudinal slots 11 and retracted into the rebate 43 of the screw sleeve 4. The middle sleeve 3 is rotated continuously to the left or to the right, and then the hollow bodies 54 corresponding to other slide blocks 52 can be chosen, namely other cosmetics are chosen.

c) Screwing out the chosen cosmetic. When the cosmetic is chosen, the button 31 on the middle sleeve 3 is released and the chosen cosmetic can be screwed out from or retracted into the screw sleeve 4 only by the continuous rotation of the middle sleeve 3 to the left or to the right. The working process thereof is as follows: herein, the slide block 52 in the longitudinal slot 11 is clamped into the rebate 42 of the screw sleeve 4. When the middle sleeve 3 rotates, the screw sleeve 4 rotates synchronously. As the spiral groove 41 is formed on the inner wall of the screw sleeve 4 and the beginning end of the spiral groove 41 is butted with the breach 42, an acting force is applied to the slide block 52 along the normal direction of the spiral groove 41 when the screw sleeve 4 rotates. As an included angle is disposed between the direction of the force and the direction of the longitudinal slot 11 of the base 1, the slide block 52 is driven by the force to move in the longitudinal slot 11 along the axial direction, and the moving direction of the slide block 52 can be changed when the rotation direction of the screw sleeve 4 is changed. The slide block 52 drives the hollow body 54 of the core post 5 to perform axial movement via the chute 51, and then the chosen cosmetic can be screwed out from or retracted into the screw sleeve 4.

d) Putting the upper cover on. The cosmetic is retracted into the hollow body 54 of the core post 5 after use. The upper cover 6 is fastened on the middle sleeve 3 provided with the screw sleeve 4, and the grooves 61 in the upper cover 6 are clamped with the upper clamping rings 32 of the middle sleeve 3. Herein, the rib 62 on the inner wall of the upper cover 6 is clamped into the longitudinal slot 11 on the cylindrical wall of the base 1, and then the fixation of the core post 5 can be guaranteed when the packaging tin is applied by an external force in the normal state.

What is claimed is:

1. A cosmetic packaging tin, comprising:

a cylindrical base with a plurality of longitudinal slots axially and uniformly formed on an upper end of a cylindrical wall of the base along an axial direction and external splines disposed on a lower of the cylindrical wall of the base, a blind end cylindrical bottom cover with radial grooves formed in a cylindrical opening of the bottom cover and internal splines corresponding to the external splines of the base and wherein the splines of the bottom cover are sleeved over the splines of the base so as to inhibit relative rotation therebetween, a cylindrical middle sleeve with an external button disposed in a middle of the middle sleeve and with upper and lower clamping rings disposed on an outside of the middle sleeve, a cylindrical screw sleeve with a rebate radially formed on the inner wall of one end of the screw sleeve and with a breach formed on the rebate and with a spiral groove formed on the inner wall of the screw sleeve and extending from the breach and wherein the screw sleeve is sleeved into the middle sleeve such that the breach matches with the button and the middle sleeve and screw sleeve are sleeved on the base, a cylindrical core post formed of a plurality of hollow bodies with chutes form on an outer cambered surfaces of each of the hollow bodies and with slide blocks arranged in the chutes and with springs disposed between the slide blocks and outer walls of the hollow bodies and configured to resiliently engage with the chutes and wherein the core post is also sleeved in the base, and a closed cylindrical upper cover disposed on the middle sleeve and with grooves radially formed in a cylindrical opening of the upper cover and with a rib formed on an inner wall of the upper cover.

* * * * *